US006186843B1

(12) United States Patent
Chen et al.

(10) Patent No.: US 6,186,843 B1
(45) Date of Patent: Feb. 13, 2001

(54) CARRIER FOR SOCKET TYPE CONTACTS HAVING COMPLIANT PINS

(75) Inventors: Hsiang-Ping Chen, Lu-Chou; Tsung-Hsi Ou Lee, Taipei, both of (TW)

(73) Assignee: Hon Hai Precision Ind. Co., Ltd., Taipei Hsein (TW)

( * ) Notice: Under 35 U.S.C. 154(b), the term of this patent shall be extended for 0 days.

(21) Appl. No.: 09/218,718

(22) Filed: Dec. 22, 1998

(30) Foreign Application Priority Data

Jan. 2, 1998 (TW) ..... 87100001

(51) Int. Cl.[7] ..... H01R 13/02
(52) U.S. Cl. ..... 439/885
(58) Field of Search ..... 439/885

(56) References Cited

U.S. PATENT DOCUMENTS 3,818,423 * 6/1974 McDonough ..... 439/885
5,175,928 * 1/1993 Grabbe ..... 439/885
5,452,512 * 9/1995 Foley et al. ..... 439/885

* cited by examiner

*Primary Examiner*—Neil Abrams

(57) ABSTRACT

A carrier (1) comprises a guiding tape (10) from which a plurality of linking strips (11) extend and engage with a plurality of contacts (12) each of which comprises a mating portion (121) having a first half (1211) and a second half (1212) connected to each other via an engagement plate (1213). A plurality of compliant pins (122) extends from the first half (1211) and each compliant pin (122) terminates as a free end (123). A plurality of linking strips (11) engages with each first half (1211). A guiding tape (10) engages with the linking strips (11) so that each linking strip (11) is connected between the first half (1211) and the guiding tape (10). A coining step to round the edge of compliant portions (1223) is to be carried out. The attachment of the guiding tape (10) to the linking strips (11) rather than to the free ends (123) of the compliant pins (122) facilitates such coining step.

16 Claims, 7 Drawing Sheets

CARRIER FOR SOCKET TYPE CONTACTS HAVING COMPLIANT PINS

BACKGROUND OF THE INVENTION

1. Field of the Invention

The present invention relates to a carrier of contacts and a method for making a final type of each contact from the carrier, and especially for making right angled contacts each of which has a plurality of compliant pins extending therefrom.

2. The Prior Art

Compliant pins have become popular in establishing contact with conductors in a multi-layer board, a back plane, or a simple circuit board having a plated through hole. A compliant pin has a compliant portion which has a normal width greater than the hole diameter but which can be deformed when it is loaded into the circuit board hole so that contact edge portions of the compliant portion will establish the electrical connection required with the conductors in the circuit board hole. The compliant portion thus is essentially a relatively stiff spring arrangement which, after insertion into the circuit board hole, will bear against the periphery of the hole with sufficient force to retain the pin in the circuit board and to establish a sound electrical contact with the circuit board conductors.

Some commonly known types of compliant pins are disclosed in U.S. Pat. Nos. 4,186,982, 4,743,081, 4,206,964, and 4,606,589. Normally, the contacts are formed in a line of a carrier by which the contacts are simultaneously machined and then loaded into the housing of the connector. The related technique can be seen in Taiwan Pat. Nos. 79,204,276, 79,207,855, 79,209,166 and 83,100,727.

For example, in FIGS. 4 and 5A, a conventional contact carrier 8 comprises a plurality of contacts 80 connected to a guiding strip 81. Each contact 80 comprises a mating portion 82 for receiving and contacting with a plug-type contact of a complementary connector (not shown), an engagement portion 83 for interferentially engaging with inner walls of a corresponding passageway of a housing which receives the contact, and a soldering tail portion 84 for being soldered to a circuit board.

Referring to FIG. 5B, the mating portion 82 is bent to form a U-shaped structure for receiving the plug-type contact of the complementary connector. An intermediate portion 86 between the engagement portion 83 and the tail portion 84 is perpendicularly bent so as to form a right angled portion of the contact 80.

Although this carrier can meet the installation of the contacts to the housing to some extent, some problems still exist during formation of the final contacts. For example, a coining procedure is executed for removing the burs existing on the tail portion 84 and forming a round edge on the tail portion 84. However, since the guiding strip 81 is directly connected to the tail portions 84, the operation of the coining procedure may destroy the engagement between the guiding strip 81 and the tail portions 84 and affect the installation of the contacts 80 to the housing. Since the right angled contact requires a bending procedure to form the right angled intermediate portion 86, an additional jig and an alignment procedure are required which complicates assembly and increases manufacturing costs.

Hence, it is requisite to provide a new contact carrier to solve the above problems as encountered in the conventional contact carrier.

SUMMARY OF THE INVENTION

The primary purpose of the present invention is to provide a contact carrier by which the contacts thereon can be finalized easily and properly.

The second purpose of the present invention is to provide a method for finalizing contacts on a carrier.

In accordance with one aspect of the present invention, a contact carrier comprises a guiding tape from which a plurality of linking strips extend and engage with a plurality of contacts each of which comprises a mating portion having a first half and a second half connected to each other via an engagement plate. A plurality of compliant pins extend from the first half and each compliant pin terminates as a free end. A plurality of linking strips engage with each first half. A guiding tape engages with the linking strips so that each linking strip is connected between the first half and the guiding tape.

In accordance with another aspect of the present invention, a method for making contacts comprises steps of: stamping on a stock metal tape to form a carrier having a guiding tape from which a plurality of linking strips extend and engage with a plurality of contacts each of which comprises a mating portion having a first half and a second half connected to each other via an engagement plate, a plurality of compliant pins extending from the first half and each compliant pin terminating as a free end, a plurality of linking strips engaging with each first half, and a guiding tape engaging with the linking strips so that each linking strip is connected between the first half and the guiding tape; coining each compliant pin and the free end thereof for forming a round edge therearound; bending the engagement plate so that the first half, the second half, and the engagement plate together form a U-shaped receptacle and bending the compliant pin to form a right angled shape; assembling the contact having the U-shaped receptacle and the right angled compliant pins in a housing; and separating the guiding tape and the linking strips from the contacts.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Figure 1:
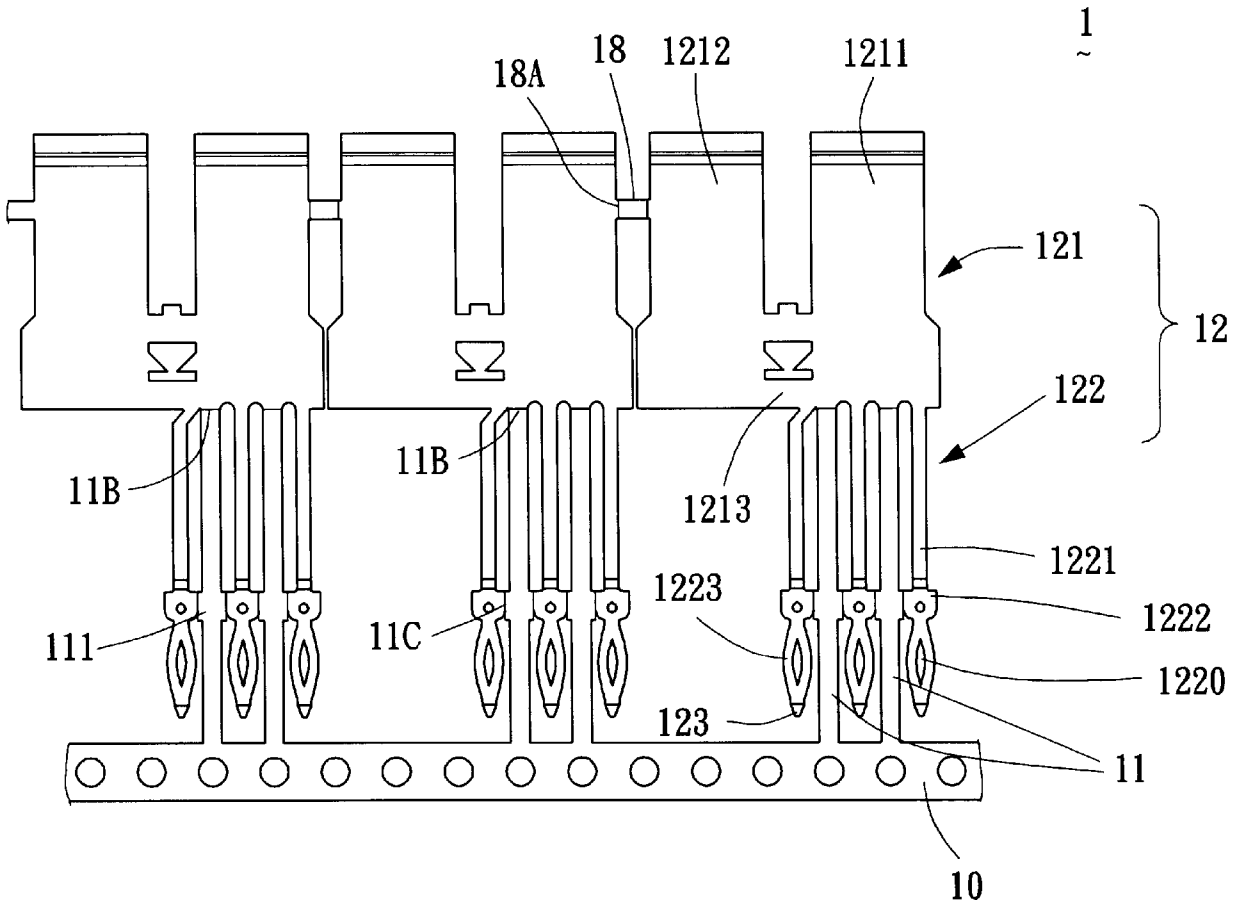
FIG. 1 is an elevational view of a carrier of the present invention carrying a line of compliant contacts.

Referring to FIG. 1, a carrier 1 in accordance with the present invention comprises a guiding tape 10 from which a plurality of linking strips 11 extend and engage with a line of semi-products of contacts 12. Each linking strip 11 has a shoulder 111 formed in an intermediate portion thereof. Each contact 12 comprises a mating portion 121 having a first half 1211 and a second half 1212 connected to the first half 1211 by means of an engagement plate 1213, and three compliant pins 122 extending from the first half 1211. Two adjacent contacts 12 are directly connected to each other by a linking tab 18 which defines two first tearing grooves 18A substantially in alignment with two boundary sides relating to a first half 1211 and a second half 1212 of the adjacent contacts 12 for facilitating disengagement between the two contacts 12 during finalization of the contact 12. Each compliant pin 122 comprises a leg portion 1221 extending from the first half 1211 of the contact 12, an engagement portion 1222 extending laterally from the leg portion 1221 and engaging with the shoulder 111 of a corresponding linking strip 11, and a compliant portion 1223 which defines a hole 1220 for providing a tolerance for deformation of the compliant portion 1223 when the compliant portion 1223 is inserted into and retained in a hole of a circuit board (not shown). A guiding tip 123 is formed as a tapered free end of the compliant portion 1223 via stamping for guiding the compliant portion 1223 into a hole of a circuit board. A second tearing groove 11B is defined in the engaging area between the first half 1211 of the contact 12 and the linking strip 11 for facilitating disengagement of the linking strip 11 from the first half 1211 during finalization of the contact 12. A third tearing groove 11C is defined in the engaging area between the compliant pin 122 and the linking strip 11 for facilitating disengagement of the compliant pin 122 from the linking strip 11 during finalization of the contact 12.

Figure 2:
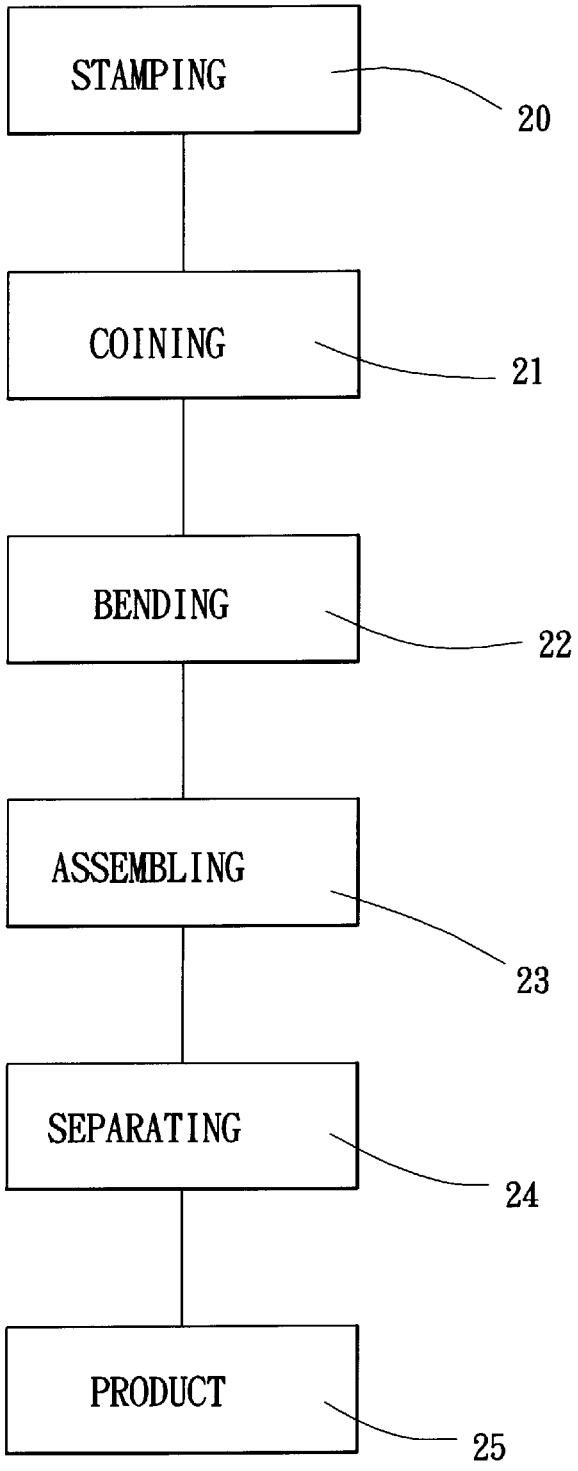
FIG. 2 is a flow chart showing steps for manufacturing the contact of FIG. 1.

Referring to FIG. 2, the carrier 1 is finalized to a final-type contact via several steps described as follows:

A first step 20 is a stamping step in which a stock metal tape (not shown) experiences stamping to form the carrier 1 of FIG. 1 having the tearing grooves 18A, 11B, 11C as described previously.

Figure 4:
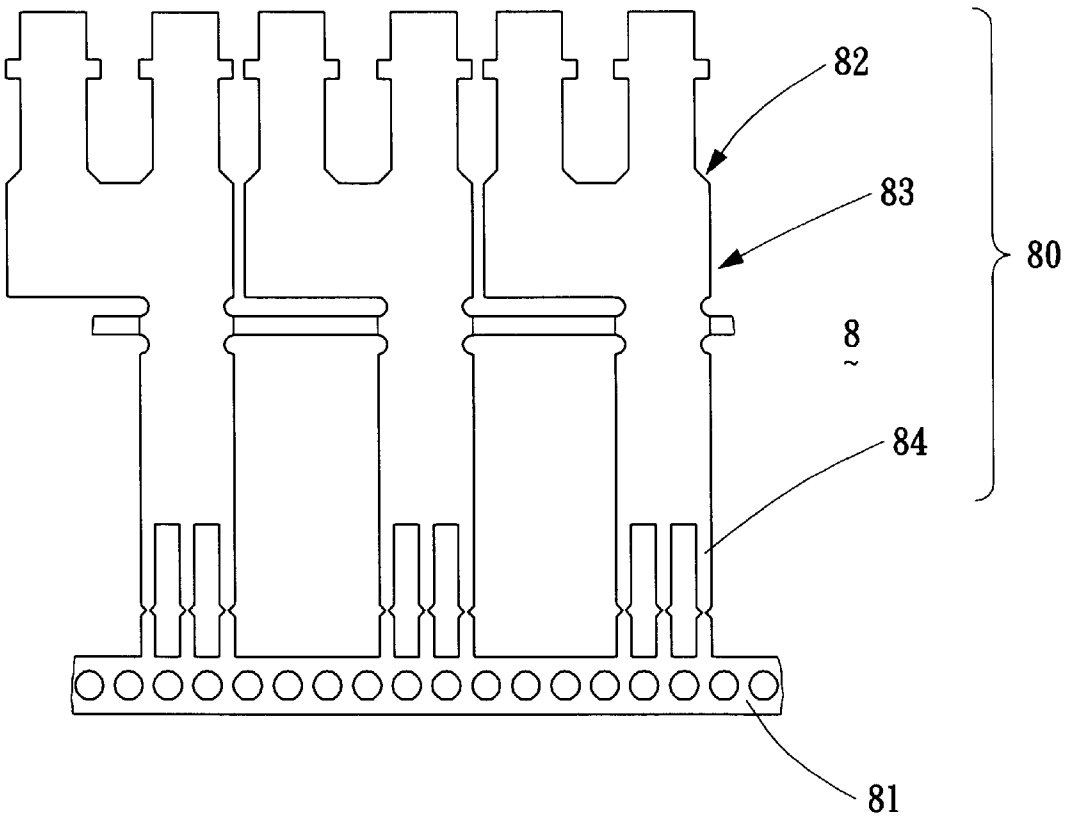
FIG. 4 PRIOR ART
FIG. 4 illustrates a conventional carrier.
Figure 5A:
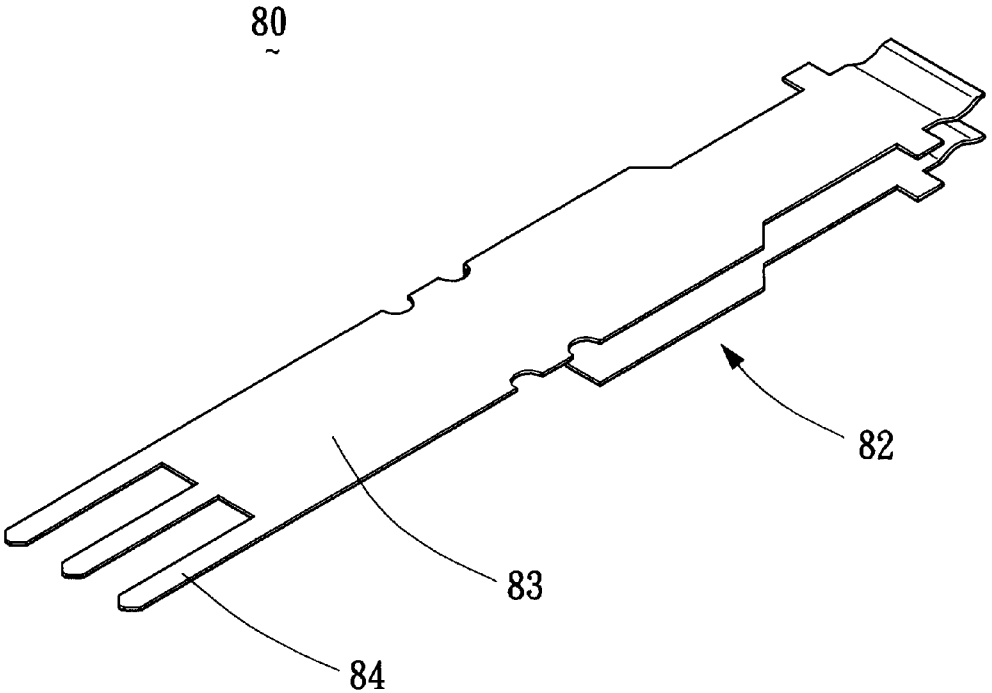
FIG. 5A PRIOR ART
FIGS. 5A and 5B illustrate a contact of FIG. 4 being processed to be a final type.
Figure 5B:
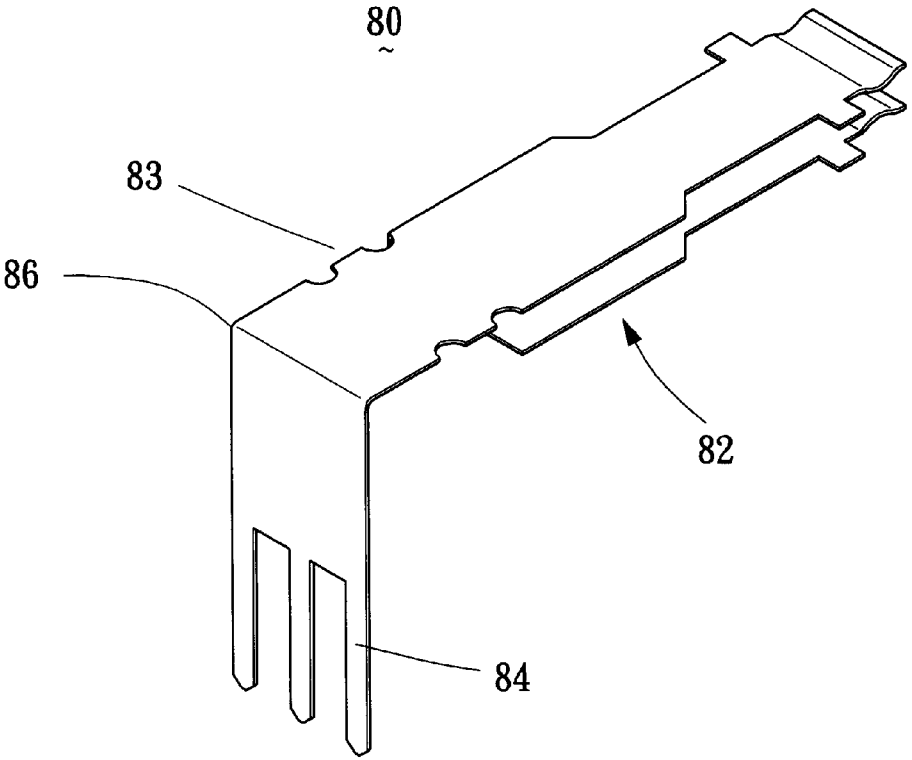
FIG. 5B PRIOR ART

A second step 21 is a coining step in which the edge of the compliant portion 1223 and the guiding tip 123 experience a coining procedure to form a round edge for facilitating insertion of the compliant portion 1223 and the guiding tip 123 into a coated hole of a circuit board (not shown). Since the linking strip 11 is connected to the engagement portion 1222 of the compliant pin 122 rather than the free end 123 thereof, the machining to the compliant portion 1223 and the guiding tip 123 of the carrier 1 is much easier than to that of the conventional carrier (FIG. 4) due to a larger space and non-connection of the free end (the guiding tip 123) to the linking strip 11.

Figure 3A:
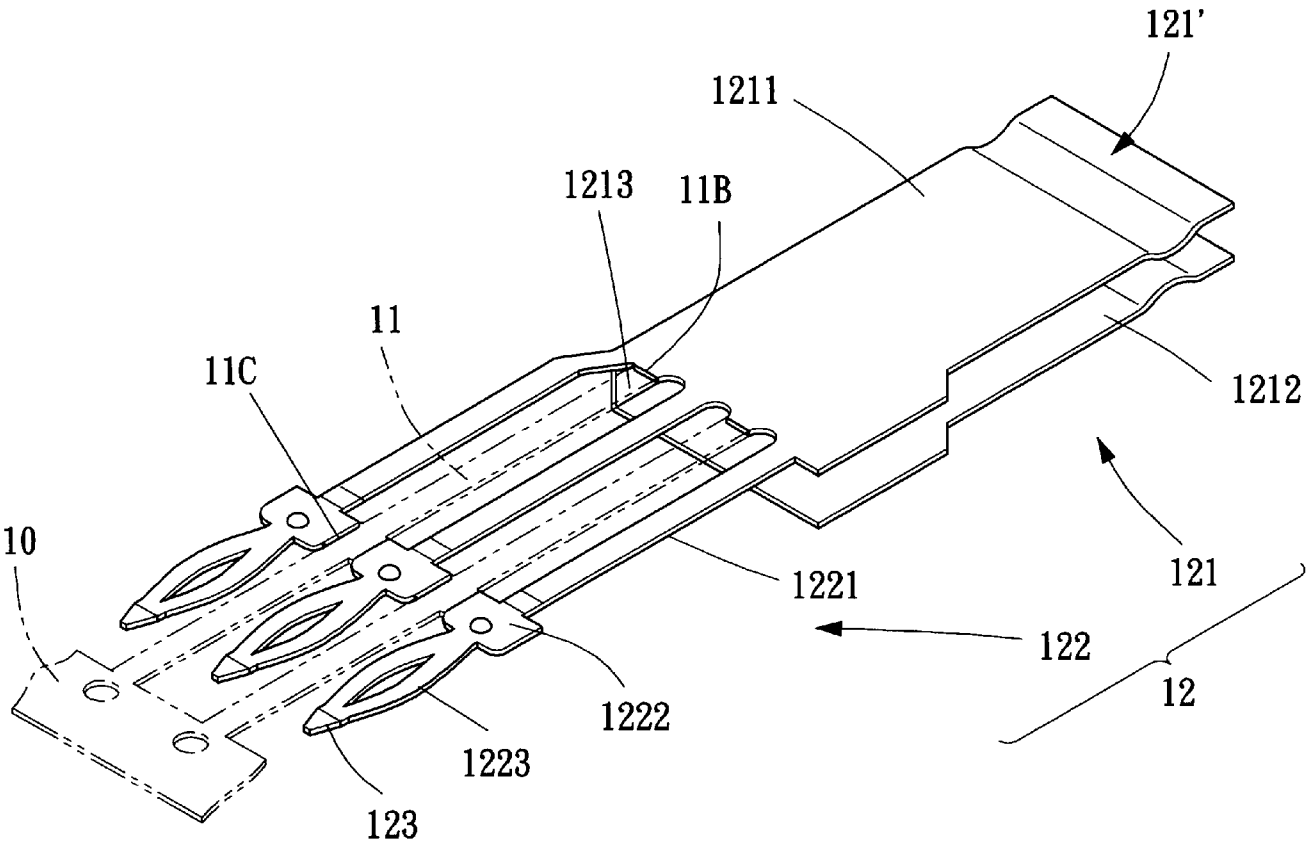
FIGS. 3A and 3B are semi-products of the contact of FIG. 1 during manufacturing, wherein the guiding tape is intentionally omitted for more clearly showing the contact.

A third step 22 is a bending step in which the linking tabs 18 are punched away from the first tearing grooves 18A thereof, and the engagement plate 1213 between the first half 1211 and the second half 1212 experiences bending. Referring to FIG. 3A, through the bending, the two halves 1211, 1212 and the engagement plate 1213 together form a U-shaped receptacle 121' adapted to receive a pin from a complementary connector (not shown) after the contact is configured in a connector housing (not shown), wherein the linking strips 11 and the guiding tape 10 are shown in phantom lines for intentionally illustrating that the engagement plate 1213 is bent compared to that of FIG. 1.

Figure 3B:
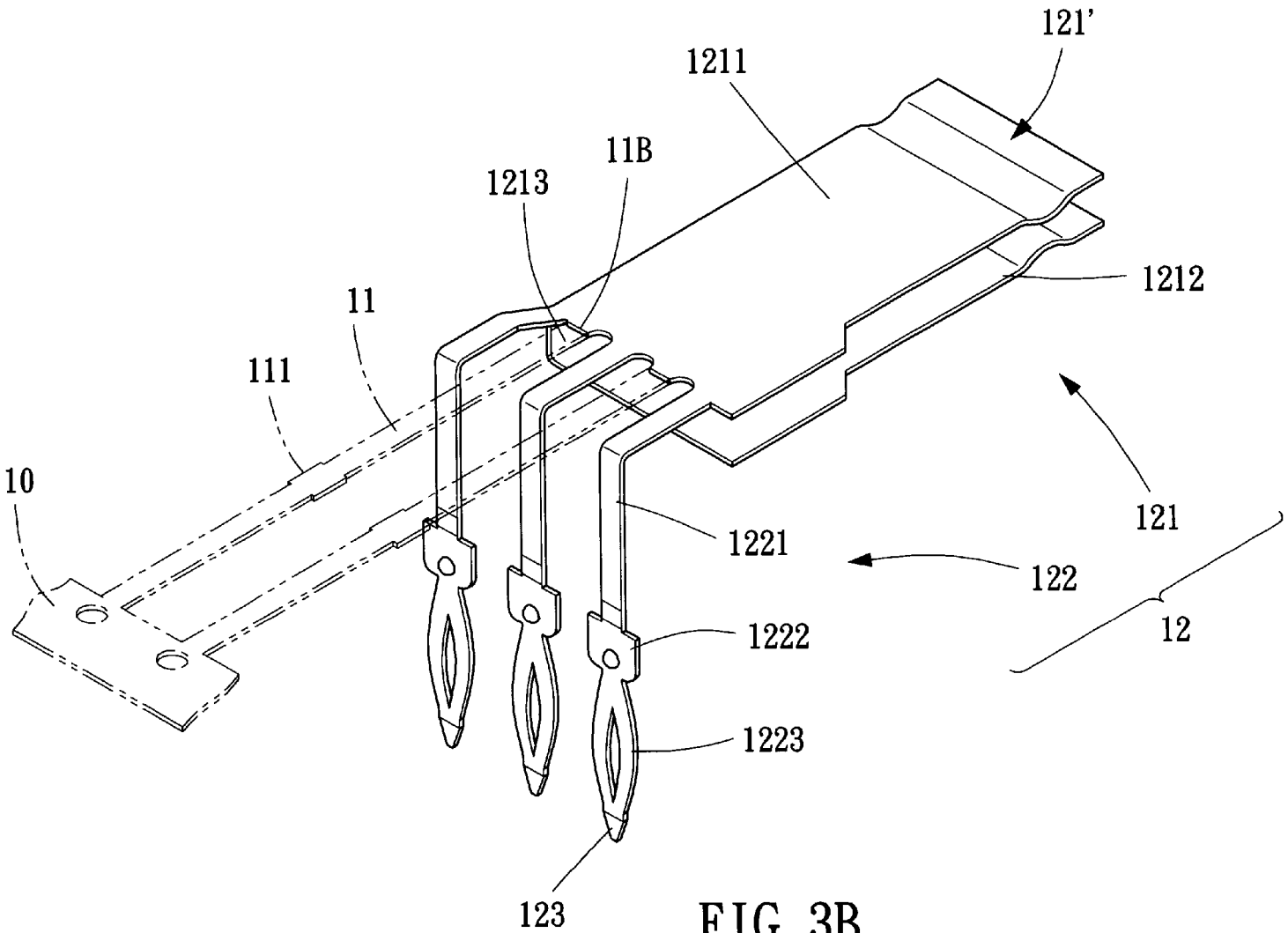

Referring to FIG. 3B, each compliant pin 122 experiences a bending procedure on the leg portion 1221 thereof, therefore the engagement between the linking strip 11 and the compliant pin 122 is broken from the third tearing groove 11C and a right angled compliant pin 122 is obtained. Since the width of each leg portion 1221 is relatively small, the bending effect on the leg portion 1221 is easily achieved and the right angled shape may be obtained precisely without further adjustment.

A fourth step 23 is an assembling procedure, in which the contacts 12 are guided to proper insertion positions in alignment with corresponding passageways of a housing (not shown) via the carrier 10 and related jig, and the receptacle 121' thereof is configured in a corresponding housing of a connector (not shown) while the compliant pins extend out of the housing. A well known positioning plate (not shown) having a plurality of ribs is attached to the housing while the ribs thereof interferentially engage with the engagement portion 1222 of each compliant pin 122, with the compliant portion 1223 of each compliant pin 122 extending out of the positioning plate for further engaging with a circuit board (not shown).

A fifth step 24 is a separating procedure in which the guiding tape 10 together with the linking strips 11 are separated from the contacts 12 via the second tearing grooves 11B thus obtaining a final product of the contact positioned in the housing as an ending step 25.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A carrier comprising a guiding tape from which a plurality of linking strips extend and engage with a plurality of contacts each of which comprises a mating portion having a first half and a second half connected to each other via an engagement plate, a plurality of compliant pins extending from the first half and each compliant pin comprising a leg portion extending from the first half of the contact, an engagement portion extending laterally from the leg portion for engaging with a corresponding linking strip, and a compliant portion which defines a hole for providing a tolerance for deformation when the compliant portion is inserted into and retained in a hole of a circuit board, the linking strips engaging with each first half, and the guiding tape engaging with the linking strips so that each linking strip is connected between the first half and the guiding tape.

2. The carrier as claimed in claim 1, wherein each linking strip is located between two compliant pins and has a shoulder connected to the engagement portion of each compliant pin adjacent to the linking strip.

3. The carrier as claimed in claim 2, wherein the free end of each compliant pin is formed to be a guiding tip by coining.

4. The carrier as claimed in claim 1, wherein adjacent contacts are directly connected to each other by a linking tab which defines two first tearing grooves for facilitating disengagement between the adjacent contacts.

5. The carrier as claimed in claim 1, wherein a second tearing groove is defined in a boundary between the linking strip and the first half of the contact for facilitating disengagement of the linking strip from the contact.

6. The carrier as claimed in claim 2, wherein a third tearing groove is defined at a boundary between the shoulder of the linking strip and the engagement portion of the compliant pin.

7. A method for making contacts comprising steps of:

stamping on a stock metal tape to form a carrier having a guiding tape from which a plurality of linking strips extend and engage with a plurality of contacts each of which comprises a mating portion having a first half and a second half connected to each other via an engagement plate, a plurality of compliant pins extending from the first half and each compliant pin terminating as a free end, a plurality of linking strips engaging with each first half, and a guiding tape engaging with the linking strips so that each linking strip is connected between the first half and the guiding tape;

coining each compliant pin and the free end thereof for forming a round edge therearound;

bending the engagement plate so that the first half, the second half, and the engagement plate together form a U-shaped receptacle, and bending the compliant pin to form a right angled shape;

assembling the contact having the U-shaped receptacle and the right angled compliant pins in a housing; and separating the guiding tape and the linking strips from the contacts.

8. The method for making contacts as claimed in claim 7, wherein the free end of each compliant pin is formed as a tapered guiding tip.

9. The method for making contacts as claimed in claim 7, wherein a separable linking tab is connected between two mating portions of two adjacent contacts before exertion of bending on the mating portions.

10. The method for making contacts as claimed in claim 9, wherein at least a first tearing groove is defined in the separable linking tab for separating the two contacts during the bending step.

11. A carrier after stamping comprising a guiding tape and a plurality of contacts side by side arranged with one another, each contact comprising free ended legs and middle engagement portions formed on the legs, said contacts being substantially laterally spaced from the guiding tape, and being connected to said guiding tape through a plurality of linking strips, wherein portions of each linking strip are connected to the middle engagement portions of two adjacent ones of said legs instead of to free ends of the legs.

12. A carrier comprising a guiding tape from which a plurality of linking strips extend and engage with a plurality of contacts each of which comprises a mating portion having a first half and a second half connected to each other via an engagement plate, a plurality of compliant pins extending from the first half, the linking strip having a shoulder and engaging with each first half so that each linking strip is connected between the first half and the guiding tape, each compliant pin comprising a leg portion extending from the first half of the contact and terminating as a free end, each linking strip located between two compliant pins, an engagement portion extending laterally from the leg portion of the compliant pin and engaging with the adjacent shoulder of the linking strip, a compliant portion which defines a hole for providing a tolerance for deformation when the compliant portion is inserted into and retained in a hole of a circuit board.

13. The carrier as claimed in claim 12, wherein the free end of each compliant pin is formed to be a guiding tip by coining.

14. The carrier as claimed in claim 12, wherein adjacent contacts are directly connected to each other by a linking tab which defines two first tearing grooves for facilitating disengagement between the adjacent contacts.

15. The carrier as claimed in claim 12, wherein a second tearing groove is defined in a boundary between the linking strip and the first half of the contact for facilitating disengagement of the linking strip from the contact.

16. The carrier as claimed in claim 12, wherein a third tearing groove is defined at a boundary between the shoulder of the linking strip and the engagement portion of the compliant pin.

* * * * *